US005123541A

United States Patent [19]

Giannini et al.

[11] Patent Number: 5,123,541

[45] Date of Patent: Jun. 23, 1992

[54] MODULAR SHIPPING CONTAINER AND CLIP FOR ASSEMBLING COMPONENTS THEREOF

[75] Inventors: Dennis A. Giannini, Poynette, Wis.; Bruce Cutler, deceased, late of Simpsonville, S.C., by Gleana Cutler, Administratrix

[73] Assignees: Penda Corporation, Portage, Wis.; Fieldcrest Cannon, inc., Greenville, S.C.

[21] Appl. No.: 675,434

[22] Filed: Mar. 26, 1991

[51] Int. Cl.[5] ..... B65D 19/06

[52] U.S. Cl. ..... 206/600; 24/457; 24/458; 220/4.33; 292/80

[58] Field of Search ..... 24/287, 457, 458, 498, 24/499, 519, 520, 564, 684, 605; 206/386, 595–600; 220/4.01, 4.21, 4.26, 4.28, 4.33; 292/80, 83, 95, 111, 121, 124

[56] References Cited

U.S. PATENT DOCUMENTS

| | | | |
|---|---|---|---|
| 150,185 | 4/1874 | Page | 292/80 |
| 278,354 | 5/1883 | Miller | 292/80 |
| 1,206,458 | 11/1916 | Monnier | 292/80 |
| 1,755,296 | 4/1930 | Hiering | 292/80 |
| 2,353,795 | 7/1944 | Tinnerman | 24/605 |
| 2,577,248 | 12/1951 | James | 292/80 |
| 2,803,476 | 8/1957 | Ivanhoe | 292/80 |
| 2,818,192 | 12/1957 | Weiner | 220/4.28 |
| 4,938,513 | 7/1990 | Gunderson | 292/80 |

FOREIGN PATENT DOCUMENTS

| | | | |
|---|---|---|---|
| 1221699 | 7/1966 | Fed. Rep. of Germany | 220/4.28 |
| 2085545 | 4/1982 | United Kingdom | 206/598 |

*Primary Examiner*—Jimmy G. Foster

*Attorney, Agent, or Firm*—Bell, Seltzer, Park & Gibson

[57] ABSTRACT

A modular shipping container and a clip for use therein to interconnect various components of the container, such as the sidewalls, bottom pallet, and top pallet. The container components are designed for compact storage and easy assembly. The clip used in the container includes a first portion for affixing the clip to the sidewall structure and a second portion having a rigid arm extending from the first portion. A resilient flex arm is attached to the end of the rigid arm farthest the first portion and extends generally toward the first portion. The flex arm has a locking face thereon for engaging an edge of a receiving slot in the pallet. Insertion of the clip into the receiving slot removably interconnects the sidewall structure to the pallet.

19 Claims, 3 Drawing Sheets

MODULAR SHIPPING CONTAINER AND CLIP FOR ASSEMBLING COMPONENTS THEREOF

FIELD OF THE INVENTION

The present invention relates to modular containers for shipping and handling containerized cargo and a clip for assembling such containers. In particular, the invention relates to a shipping container that may be easily assembled or disassembled by engaging or disengaging a plurality of clips that interconnect portions thereof.

BACKGROUND OF THE INVENTION

Modern cargo shipping techniques and the resultant enhancements in cargo handling efficiency have required the development of especially designed containers for transporting bulk cargo. As a result, modular shipping containers have been developed to permit compact storage of goods for transport and to facilitate easy loading and unloading of shipping vehicles. A shipping container must be suited for easy movement about the loading dock and is usually designed to allow stacking of multiple containers for maximum space utilization on the dock or aboard a truck trailer, railroad car, aircraft or cargo vessel.

Most cargo shipping containers define a square or rectangular enclosure within which a desired cargo may be carried. Such containers may be constructed from a base pallet, sidewalls, and a top pallet which may be assembled into a container that defines a fully enclosed space. Empty shipping containers are bulky and hard to store, as they consist of rigid walls defining an empty space. Thus, to minimize the storage space necessary for empty containers and to facilitate easy handling, shipping containers have been constructed of modular components which may be disassembled and stored separately. The base pallet, sidewalls, and top pallet are often stackable, foldable, yet nestable, or are otherwise designed to allow compact storage.

Modular container construction requires means to interconnect the base pallet, sidewalls, and top pallet to form a strong container suited for transporting heavy cargoes. The interconnecting means should be simple and easy to use, thereby minimizing the labor necessary to assemble or disassemble a container. The interconnecting means also must be lightweight and should be compact to avoid interfering with the compact storage cf each pallet or sidewall. Additionally, the interconnecting means must withstand repeated assembly and disassembly and must fasten the sidewall and pallet components securely enough to maintain the integrity of the shipping container during rough treatment. The shipping containers and related interconnecting means disclosed in the prior art have not satisfied all of these requirements.

With the foregoing in mind, it is an object of the present invention to provide a shipping container that may be readily assembled and disassembled from modular components.

Another object of this invention is to provide a clip for removably interconnecting the modular components of a shipping container.

A further object of this invention is to provide a clip for securely interconnecting the modular components of a shipping container that is simple and easy to use.

Yet another object of this invention is to provide a clip for assembling a modular shipping container which will withstand repeated assembly and disassembly.

Still another object of the present invention is to provide a clip for interconnecting modular components of a shipping container which facilitates easy storage of the modular container components.

An even further object of the present invention is to provide a compact clip for interconnecting the modular components of a shipping container.

Other objects will become apparent from the following description.

SUMMARY OF THE INVENTION

The invention comprises a modular shipping container and a clip for assembling components thereof. The container comprises a base pallet, a sidewall structure and a top pallet which are removably interconnected by one or more clips. The clips are attached to the sidewall structure along its edges and are adapted for insertion into receiving slots disposed about the periphery of the top and bottom pallets. Each clip includes a first portion which has means for securely affixing the clip to the sidewall structure and a second portion for engaging a pallet. The second portion of the clip includes a rigid arm that supports a resilient flex arm biased outwardly from the rigid arm and having a tab extending therefrom which defines a locking face for engaging the top or bottom pallet. When a clip is inserted into a clip receiving slot of a pallet, the flex arm and locking face are deflected toward the rigid arm so that they may pass through the slot in the pallet. After passing through the slot, the flex arm resumes its relaxed position so that the locking face engages an edge of the receiving slot. A clip may be removed from a receiving slot by depressing the tab on the flex arm to displace the locking face from its engaged position adjacent the receiving slot. Thus, the clips may be removed from the pallets to disassemble the shipping container and to permit each modular component of the container to be stored separately.

BRIEF DESCRIPTION OF THE DRAWINGS

The foregoing and other objects, advantages and features of this invention, and the manner in which the same are accomplished, will become more readily apparent upon consideration of the following detailed description of the invention taken in conjunction with the accompanying drawings, which illustrate a preferred and exemplary embodiment, and wherein.

DESCRIPTION OF THE PREFERRED EMBODIMENT

Figure 1:
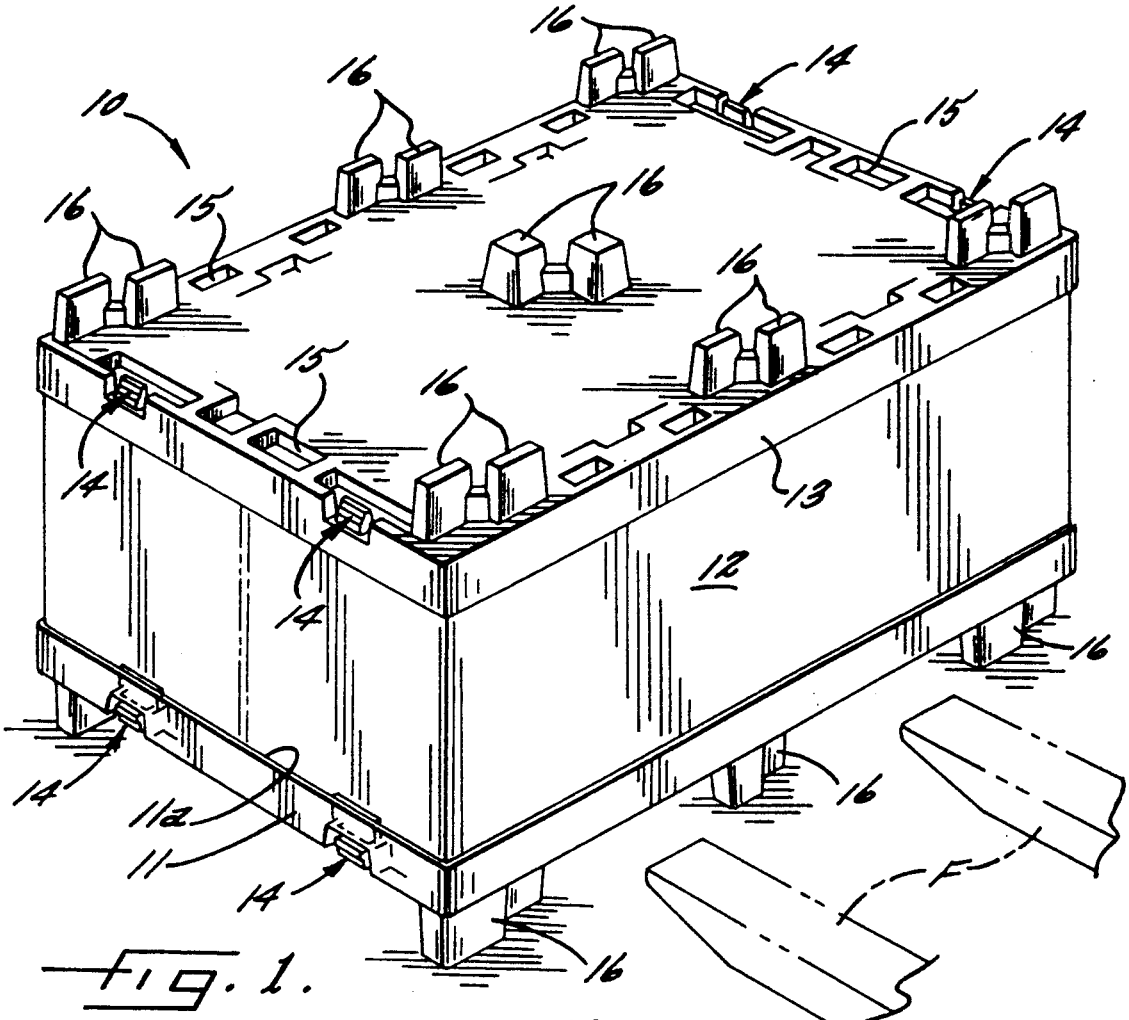
FIG. 1 is a perspective view of an assembled shipping container constructed in accordance with the present invention.

The present invention is a modular shipping container and a clip for assembling components thereof. As shown in FIG. 1, the shipping container 10 includes a base pallet 11, sidewall structure 12 and top pallet 13. The base pallet 11 and top pallet 13 may be interchangeable. The base pallet 11, sidewall structure 12 and top pallet 13 are removably interconnected by one or more clips 14, which are affixed to the sidewall structure 12 and which engage the pallets 11 and 13 at points along their peripheries. In a preferred embodiment, four clips 14 are spaced along the lower edge 12*a* of the sidewall structure 12 such that two clips are positioned at opposing sidewalls. Likewise, four clips 14 are affixed to the upper edge 12*b* of the sidewall structure 12.

Figure 2:
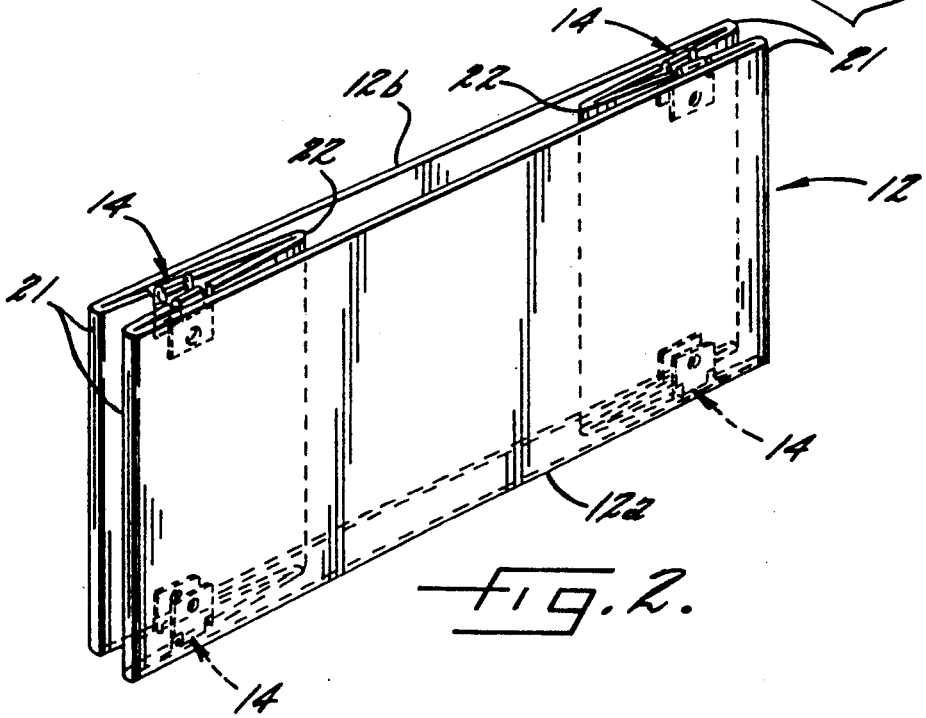
FIG. 2 illustrates a sidewall structure in its folded position that is constructed in accordance with the present invention.

In a preferred embodiment, the sidewall structure 12 is made of corrugated medium which has folds preformed at corners 21 and at midpoints 22 of opposing sidewalls. Thus, the sidewall structure 12 may be collapsed into a substantially flat shape for compact storage, as shown in FIG. 2. In one preferred embodiment, the sidewall structure 12 is made of multi-layered corrugated medium which is about 5/8 inch thick and about two feet wide from edge to edge.

In a preferred embodiment, the base pallet 11 and top pallet 13 are made of plastic and have depressions 15 disposed about their surfaces for enhanced rigidity, as partially illustrated in FIG. 1. The base pallet 11 and top pallet 13 also include a plurality of diagonally paired projections 16 which support the container 10 above a floor and provide space above and below the container 10 to permit handling by a forklift F. The diagonal projections 16 also permit multiple stacking of containers 10 by engaging the pallet projections on another container placed immediately above or below the container.

Figure 3:
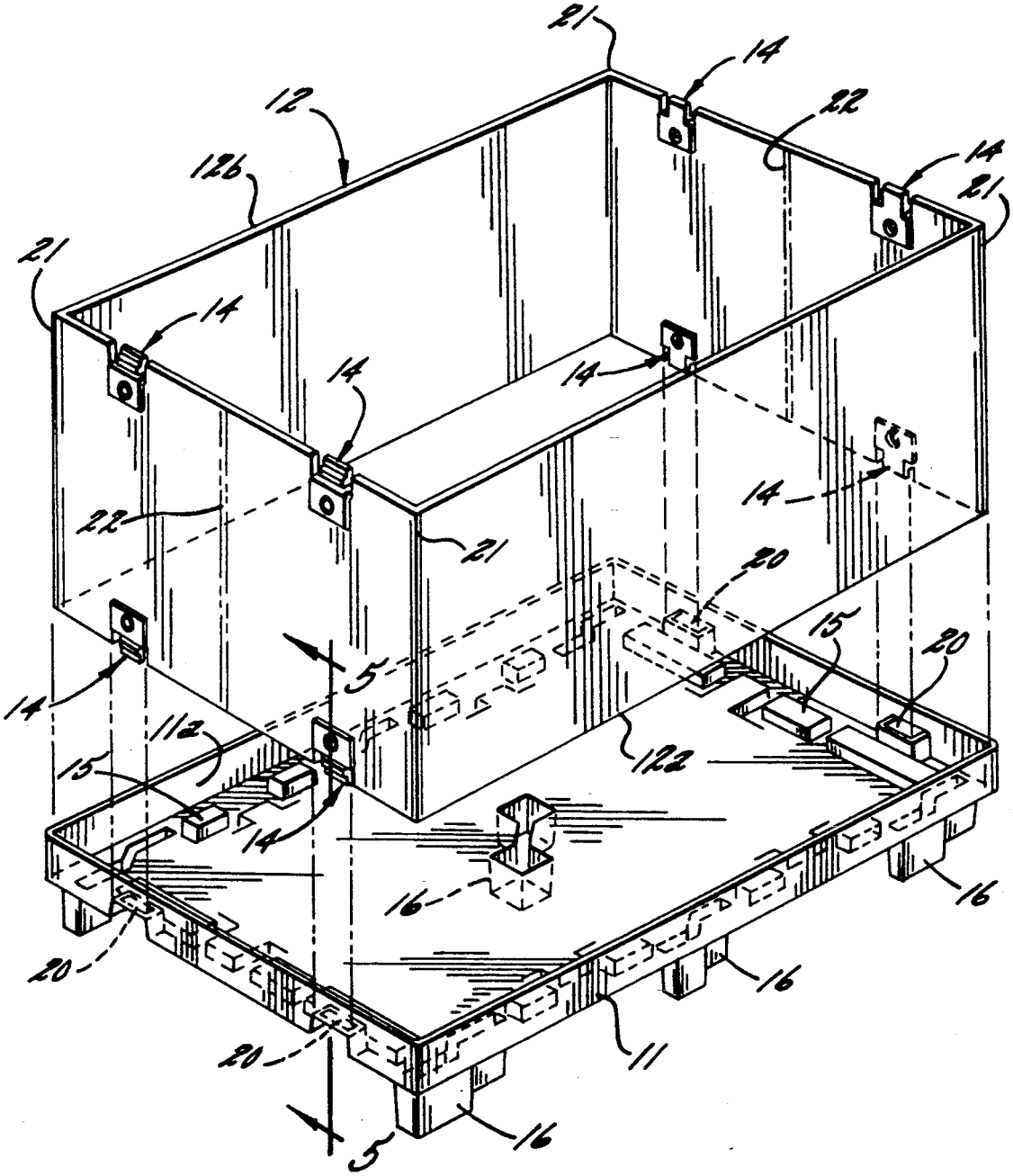
FIG. 3 is an exploded perspective view of a shipping container constructed in accordance with the present invention which illustrates the assembly of the sidewall structure and base pallet components of the container.
Figure 5:
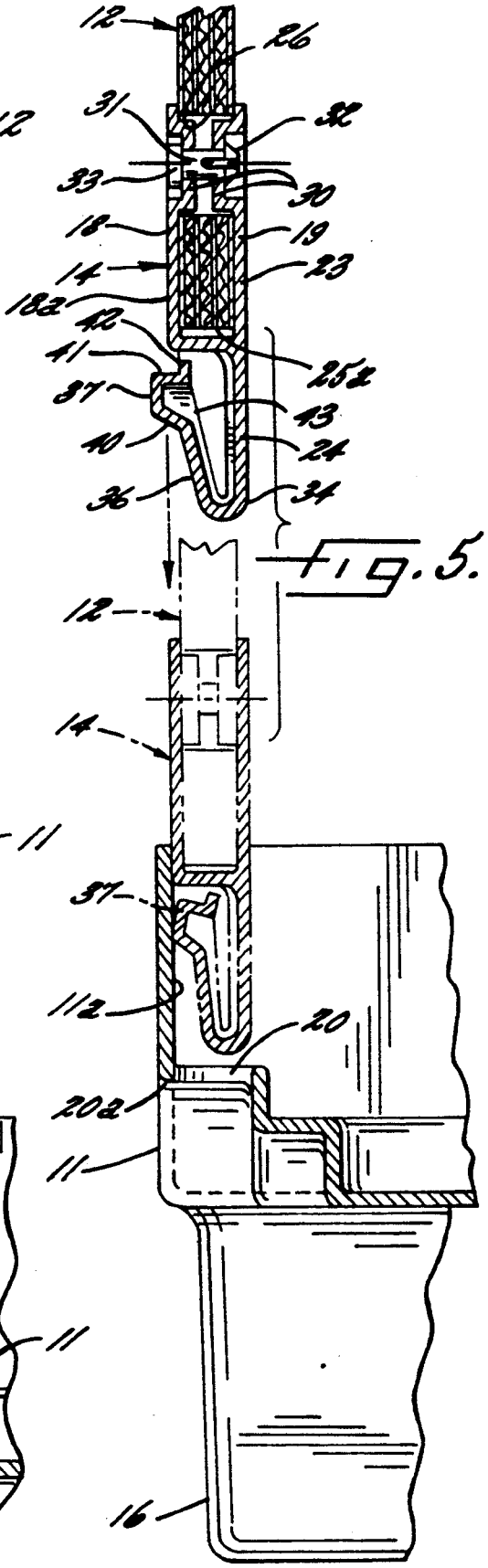
FIG. 5 is a cross sectional view taken along line 5—5 of FIG. 3 which illustrates portions of the sidewall structure, clip and base pallet.
Figure 6:
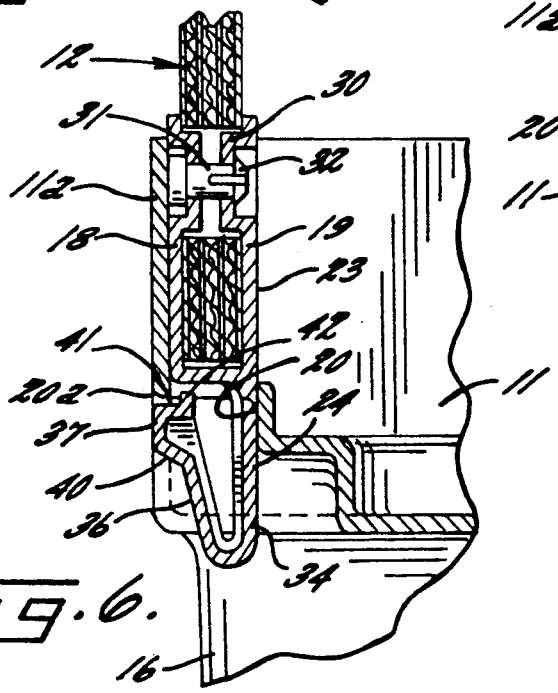
FIG. 6 is a cross sectional view illustrating the clip in its engaged position.

As shown in FIGS. 3 and 5, the sidewall structure 12 and base pallet 11 may be assembled by positioning a lower edge 12*a* of the sidewall structure 12 within a raised lip 11*a* of the base pallet 11. The clips 14 are then inserted into receiving slots 20 of the base pallet 11, as shown in FIG. 6 and by the dotted lines in FIG. 3. Although not shown, assembly of the top pallet 13 and the sidewall structure 12 is identical to assembly of the base pallet 11 and the sidewall structure 12.

Figure 4:
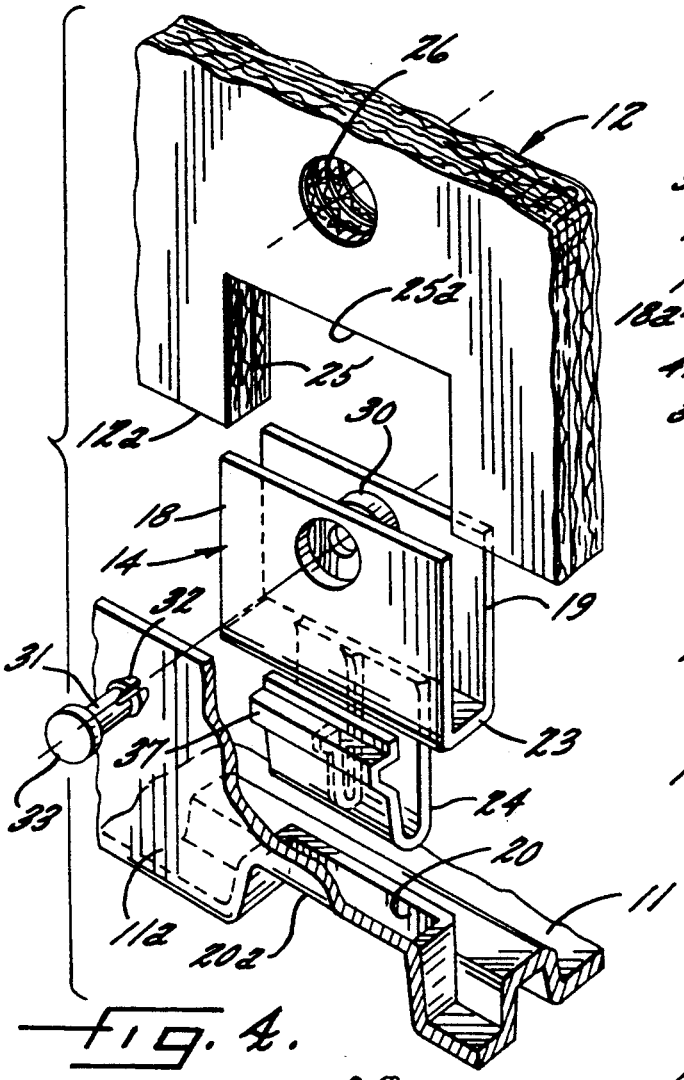
FIG. 4 is a cut away, exploded perspective view showing a clip with portions of the sidewall structure and base pallet of the present invention.

FIG. 4 shows part of the sidewall structure 12 near its lower edge 12*a*. A clip 14 and a portion of the base pallet 11 are also shown. The clip 14 includes a first portion 23 and a second portion 24. The first portion 23 includes means for affixing the clip 14 to the sidewall structure 12. The affixing means may include at least one rigid flange that may be secured to the sidewall structure 12. The flange should be of sufficient height and width to ensure the stability of the clip 14 with respect to the sidewall structure 12. In a preferred embodiment, the affixing means is an outside flange 18 and an inside flange 19 arranged in a U-shape for surrounding a portion of the sidewall structure 12, as best shown in FIG. 6. In a preferred embodiment, the outside and inside flanges 18 and 19 are each about 2½ inches high and about 3 inches wide.

The sidewall structure 12 may also include a sidewall recessed area 25 within which the first portion 23 and a portion of the second portion 24 are fitted. In a preferred embodiment, the recessed area 25 is about 1¼ inch deep and about 4 inches wide.

Also in a preferred embodiment, a clip retaining hole 26 passes through the sidewall structure 12 and is positioned slightly above the recessed area 25. The clip retaining hole 26 may be about 1 inch in diameter, and should be of sufficient size to accept perforated spacers 30, which are formed by depressions in the flanges 18 and 19 of first portion 23 of the clip 14. The spacers 30 define a hole through which a securing means such as pin 31 may pass. Other means for securing the clip 14 to the sidewall structure 12 may be substituted for the pin 31.

The first portion 23 and second portion 24 may be formed of a single molded piece of plastic. In one preferred embodiment the pin 31 is also molded in a single piece with the first portion 23 and the second portion 24 and is connected to first portion 23 by a thin ribbon of plastic (not shown).

FIG. 5 illustrates clip 14 attached to the sidewall structure 12 with the pin 31 extending through the clip retaining hole 26 and the spacers 30. The pin 31 includes a slotted conical head 32 and a flat head 33. The diameter at the base of the slotted conical head 32 is greater than the diameter of the hole defined by the spacers 30 so that when the pin 31 is pushed through holes in the spacers 30, the slotted conical head 32 is compressed to permit passage through the hole but expands afterwards to retain the pin 31 securely within the hole defined by the spacers 30. The spacers 30 extend partially within the clip retaining hole 26 so that the first portion 23 is retained securely against an upper edge 25*a* of the recessed area 25.

The second portion 24 includes a rigid arm 34 extending outwardly from the first portion 23 and a resilient flex arm 36 having a locking face 41. When the clip 14 is affixed to the sidewall structure 12, the rigid arm 34 extends away from and in the plane of the Sidewall structure 12. The flex arm 36 is attached to the end of the rigid arm 34 that is farthest from the first portion 23 and extends generally toward the first portion 23. The flex arm 36 is biased outwardly from the rigid arm 34 so that the upper portion of the flex arm 36 will resume a relaxed shape away from the rigid arm 34 after being deflected toward the rigid arm 34. In a preferred embodiment, a tab 37 extends outwardly from the flex arm 36 and defines a deflecting face 40, locking face 41 and locking shim 42. The deflecting face 40 is angled relative to the flex arm 36 to facilitate easy insertion of the clip 14 into receiving slot 20. A reinforcing rib 43 extends along the axis of the second portion 24 on the interior surfaces of the flex arm 36 and the rigid arm 34. In a preferred embodiment, reinforcing rib 43 is thickest within the tab 37. Reinforcing rib 43 stiffens the flex arm 36 and the rigid arm 34 and prevents collapse of tab 37 when it is depressed or comes into contact with an external surface. In a preferred embodiment, the second portion 24 is about 1½ inches long and about 1½ inches wide, and the locking face 41 is about ¼ inch wide.

As shown in the upper portion of FIG. 5, portions of the tab 37 and the locking face 41 extend slightly beyond the plane defined by the outer surface 18*a* of the outside flange 18. As shown in the bottom portion of FIG. 5, positioning of the sidewall structure 12 and the clip 14 immediately within the inner surface defined by the raised lip 11*a* of the base pallet 11 causes deflection of the tab 37 and the flex arm 36 toward the rigid arm 34. As the clip 14 is moved further within the interior of raised lip 11*a* it passes into the clip receiving slot 20. As shown in FIG. 6, once the second portion 24 of the clip 14 is inserted into the receiving slot 20, the flex arm 36, including the tab 37, moves away from the rigid arm 34 to a relaxed position. Thus, the locking face 41 engages an edge 20*a* of the receiving slot 20 to retain the clip within the slot 20, thereby removably interconnecting the sidewall structure 12 to the pallet 11.

The clip 14 may be removed from the receiving slot 44 by depressing the outer surface of the tab 37 and pulling the sidewall structure 12 away from the base pallet 11. Disassembly of the sidewall structure 12 from the top pallet 13 is accomplished in similar fashion.

In the drawings and specification, there has been disclosed a typical preferred embodiment of the invention. Although specific terms have been employed, they have been used in a generic and descriptive sense only and not for purposes of limitation, the scope of the invention being set forth in the following claims.

That which is claimed:

1. A modular shipping container, comprising:
a pallet having a clip receiving slot; and
a sidewall structure having a clip affixed near an edge thereof, said clip comprising a first portion having means for affixing said clip to said sidewall structure and a second portion comprising a rigid arm extending outwardly from said first portion in the plane of said sidewall structure, a resilient flex arm attached to the end of said rigid arm farthest from said first portion and extending generally toward said first portion, said flex arm being biased outwardly from said rigid arm and having a locking face thereon for engaging an edge of said receiving slot, whereby said second portion may be inserted into said receiving slot to removably interconnect said sidewall structure and said pallet.

2. The container as defined in claim 1 further comprising a clip affixed to the opposite edge of said sidewall structure and a second pallet secured to said other edge of said sidewall by said clip.

3. The container as defined in claim 1 further comprising a tab extending from said flex arm which defines said locking face.

4. The container as defined in claim 3 wherein said tab further comprises a deflecting face to facilitate easy insertion of said clip into said receiving slot.

5. The container as defined in claim 4 wherein said tab may be depressed to deflect said flex arm toward said rigid arm to move said locking face from its position in engagement with said pallet to permit removal of said clip from said receiving slot.

6. The container as defined in claim 3 further comprising a reinforcing rib extending on interior surfaces of said flex arm and rigid arm, whereby said flex arm and rigid arm are stiffened and whereby said tab will not collapse.

7. The container as defined in claim 1 wherein said first portion comprises an outside flange and an inside flange arranged in a U-shape for surrounding a portion of said sidewall structure.

8. The container as defined in claim 7 further comprising securing means passing through said U-shaped flanges and said sidewall structure to affix said clip along said edge of said sidewall structure.

9. The container as defined in claim 7 wherein said means for affixing said clip to said sidewall structure comprises a clip retaining hole extending through said sidewall structure and between said outside and inside flanges, and a pair of depressed spacers positioned on respective ones of said outside and inside flanges and so as to extend partially through said retaining hole from the opposite ends thereof.

10. The container as defined in claim 9 wherein said spacers are perforated, and said means for affixing said clip to said sidewall structure further comprises a pin extending transversely through said perforations of said spacers.

11. The container as defined in claim 10 wherein said pin includes a head at each end thereof, and wherein said heads are sized so as to be received within the associated spacer and so that the heads are recessed below the outer surfaces of the outside and inside flanges.

12. The container as defined in claim 1 wherein a plurality of said clips are affixed to said edge of said sidewall structure.

13. The container as defined in claim 1 wherein said sidewall structure is foldable for easy storage.

14. The container as defined in claim 1 wherein said sidewall structure further comprises a recessed area along its edge at which point said clip is affixed.

15. A clip having first and second portions for removably interconnecting a pallet having a clip receiving slot therein and a sidewall structure having a clip affixed along an edge thereof so that the pallet and sidewall structure may be assembled to form a modular shipping container, said clip comprising:
a first portion comprising parallel outside and inside flanges arranged in a U-shape for surrounding a portion of the sidewall structure;
a pair of perforated spacers positioned on respective ones of said outside and inside flanges, with said spacers being transversely aligned and extending into the space between said flanges;
a pin for being received through said perforations of said spacers to affix said clip to the sidewall structure, said pin having a head at each end thereof, with said heads being of a size larger than said perforations in said spacers and smaller than said spacers and so that said heads are totally received in said associated spacers; and
a second portion comprising a rigid arm extending outwardly from said first portion in a plane generally parallel to said outside and inside flanges, a resilient flex arm attached to the end of said rigid arm farthest from said first portion and extending generally towards said first portion, said flex arm being biased outwardly from said rigid arm and having a locking face thereon for engaging an edge of the receiving slot, whereby said second portion may be inserted into the receiving slot to removably interconnect the sidewall structure and the pallet.

16. The clip as defined in claim 15 further comprising a tab extending from said flex arm which defines said locking face.

17. The clip as defined in claim 16 wherein said tab further comprises a deflecting face to facilitate easy insertion of said clip into the receiving slot.

18. The clip as defined in claim 16 wherein said tab may be depressed to deflect said flex arm toward said rigid arm to move said locking face from its position in engagement with said pallet to permit removal of said clip from the receiving slot.

19. A clip having first and second portions for removably interconnecting a pallet having a clip receiving slot therein and a sidewall structure having a clip affixed along an edge thereof so that the pallet and sidewall structure may be assembled to form a modular shipping container, said clip comprising:

a first portion having means for affixing said clip to the sidewall structure; and a second portion comprising:

a rigid arm extending outwardly from said first portion in the plane of the sidewall structure;

a resilient flex arm attached to the end of said rigid arm farthest from said first portion and extending generally toward said first portion, said flex arm being biased outwardly from said rigid arm and having a locking face thereon for engaging an edge of the receiving slot;

a tab extending from said flex arm for defining said locking face; and a reinforcing rib extending on interior surfaces of said flex arm and said rigid arm to stiffen said flex arm and said rigid arm and to prevent collapse of said tab, whereby said second portion may be inserted into the receiving slot to removably interconnect the sidewall structure and the pallet.

* * * * *

UNITED STATES PATENT AND TRADEMARK OFFICE

CERTIFICATE OF CORRECTION

PATENT NO. : 5,123,541

DATED : June 23, 1992

INVENTOR(S) : Giannini et al

It is certified that error appears in the above-indentified patent and that said Letters Patent is hereby corrected as shown below:

On the title page:

UNDER [75] "Inventors":

"Gleana" should be --Glenna--.

UNDER [73] "Assignees":

"inc." should be --Inc.--.

UNDER [56] References Cited - U.S. PATENT DOCUMENTS:

UNITED STATES PATENT AND TRADEMARK OFFICE

CERTIFICATE OF CORRECTION

PATENT NO. : 5,123,541

DATED : June 23, 1992

INVENTOR(S) : Giannini et al

It is certified that error appears in the above-indentified patent and that said Letters Patent is hereby corrected as shown below:

Please insert the following cited references:

| | | |
|---|---|---|
| 2,893,588 | 7/1959 | Martin |
| 3,664,570 | 5/1972 | Kupersmit |
| 3,986,659 | 10/1976 | Vajtay |
| 4,212,415 | 7/1980 | Neely |
| 4,445,614 | 5/1984 | Mitsumori et al. |
| 4,765,252 | 8/1988 | Shuert |

At column 1, line 51, "cf" should be --of--.

At column 4, line 36, "Sidewall" should be --sidewall--.

Signed and Sealed this

Third Day of August, 1993

*Attest:*

*Attesting Officer*

Michael K. Kirk

MICHAEL K. KIRK

*Acting Commissioner of Patents and Trademarks*